US008864447B1

(12) United States Patent
Humphrey

(10) Patent No.: US 8,864,447 B1
(45) Date of Patent: Oct. 21, 2014

(54) LOW-PROFILE, CEILING-MOUNTED FAN

(76) Inventor: Sharon K. Humphrey, Tulsa, OK (US)

( * ) Notice: Subject to any disclaimer, the term of this patent is extended or adjusted under 35 U.S.C. 154(b) by 610 days.

(21) Appl. No.: 13/175,076

(22) Filed: Jul. 1, 2011

Related U.S. Application Data

(60) Provisional application No. 61/360,692, filed on Jul. 1, 2010.

(51) Int. Cl.
*F24F 1/02* (2011.01)

(52) U.S. Cl.
USPC ..... 415/118

(58) Field of Classification Search
CPC ..... F24F 7/013
USPC ..... 415/53.1, 206; 62/300; 700/276; 392/356
See application file for complete search history.

(56) References Cited

U.S. PATENT DOCUMENTS

| | | | | | |
|---|---|---|---|---|---|
| 1,870,570 | A | * | 8/1932 | Hueglin | 454/210 |
| 2,275,564 | A | * | 3/1942 | Shawhan et al. | 454/205 |
| 2,296,635 | A | * | 9/1942 | Foehrenbach et al. | 454/205 |
| 2,337,325 | A | * | 12/1943 | Hach et al. | 454/205 |
| 2,553,172 | A | * | 5/1951 | Carrick | 454/210 |
| 2,659,294 | A | * | 11/1953 | Hersperger | 454/205 |
| 3,068,341 | A | * | 12/1962 | Ortiz et al. | 219/220 |
| 3,097,287 | A | * | 7/1963 | Knoll et al. | 392/436 |
| 3,147,368 | A | * | 9/1964 | Walker | 392/353 |
| 3,275,224 | A | * | 9/1966 | Bush | 454/200 |
| 3,309,502 | A | * | 3/1967 | Witherspoon, Jr. | 392/364 |
| 3,320,406 | A | * | 5/1967 | Wainwright | 392/364 |
| 3,326,112 | A | * | 6/1967 | Sadlow et al. | 454/248 |
| 3,341,689 | A | | 9/1967 | Reichenbach | |
| 3,785,271 | A | * | 1/1974 | Joy | 454/356 |
| 3,846,617 | A | * | 11/1974 | Glucksman | 392/368 |
| 3,909,589 | A | * | 9/1975 | Stone et al. | 392/347 |
| 3,926,537 | A | * | 12/1975 | Piper | 417/353 |
| 4,073,597 | A | * | 2/1978 | Barnhart et al. | 415/201 |
| 4,235,368 | A | * | 11/1980 | Neel | 236/94 |
| 4,362,922 | A | * | 12/1982 | Anderson | 392/368 |
| 4,642,441 | A | * | 2/1987 | Kenyon | 392/365 |
| 4,773,310 | A | * | 9/1988 | Corwin | 454/244 |
| 5,000,381 | A | * | 3/1991 | Mueller et al. | 236/44 C |
| 5,046,407 | A | * | 9/1991 | Nielsen et al. | 454/200 |
| 5,525,107 | A | * | 6/1996 | Shao | 454/204 |
| 5,547,018 | A | * | 8/1996 | Takahashi et al. | 165/267 |
| 5,590,831 | A | * | 1/1997 | Manson et al. | 236/51 |
| 5,632,677 | A | * | 5/1997 | Elkins | 454/329 |
| 5,637,039 | A | * | 6/1997 | Chiu et al. | 454/200 |
| 5,658,130 | A | | 8/1997 | Goldstein et al. | |
| 5,660,586 | A | * | 8/1997 | Chiu et al. | 454/200 |
| 5,660,605 | A | * | 8/1997 | Chan et al. | 96/19 |
| 5,664,872 | A | * | 9/1997 | Spearman et al. | 362/96 |
| 5,678,417 | A | * | 10/1997 | Nigo et al. | 62/186 |
| 5,697,226 | A | * | 12/1997 | Marchesi | 62/263 |
| 5,730,651 | A | * | 3/1998 | Chen et al. | 454/205 |

(Continued)

*Primary Examiner* — Edward Look
*Assistant Examiner* — Eldon Brockman
(74) *Attorney, Agent, or Firm* — Robert C. Montgomery; Montgomery Patent & Design

(57) ABSTRACT

A low-profile ceiling fan which utilizes a fan assembly in a horizontal configuration is herein disclosed. The fan includes an enclosure that mounts to the ceiling. The fan has a low-profile design for low ceilings as commonly found in basements, attics, patio enclosures, mobile homes, recreational vehicles and similar locations. The fan enclosure includes at least one fluorescent lamp mounted alongside the fan. Accessories such as heaters, security cameras, a remote control, and the like are available. The fan includes a heating element and a blower to distribute heated air.

20 Claims, 6 Drawing Sheets

(56) References Cited

U.S. PATENT DOCUMENTS

| | | | | |
|---|---|---|---|---|
| 5,761,377 | A | 6/1998 | Wolfe et al. | |
| 6,079,626 | A * | 6/2000 | Hartman | 236/13 |
| 6,086,324 | A * | 7/2000 | Ikeda et al. | 415/53.1 |
| 6,145,334 | A * | 11/2000 | Mochizuki et al. | 62/262 |
| 6,154,606 | A * | 11/2000 | Shaw et al. | 392/360 |
| 6,631,243 | B2 * | 10/2003 | Reiker | 392/364 |
| 6,810,205 | B2 * | 10/2004 | Kaplanis et al. | 392/422 |
| 6,830,433 | B2 | 12/2004 | Birdsell et al. | |
| 7,059,826 | B2 | 6/2006 | Lasko | |
| D528,650 | S | 9/2006 | Shapiro | |
| 7,182,805 | B2 * | 2/2007 | Reaves | 96/24 |
| 7,455,500 | B2 * | 11/2008 | Penlesky et al. | 415/206 |
| 7,457,533 | B2 * | 11/2008 | Hess et al. | 392/356 |
| 7,734,381 | B2 * | 6/2010 | Conger et al. | 700/301 |
| 8,087,980 | B2 * | 1/2012 | Palmer | 454/255 |
| 8,347,950 | B2 * | 1/2013 | Stroobants | 165/55 |
| 8,364,317 | B2 * | 1/2013 | Park et al. | 700/276 |
| 8,371,913 | B1 * | 2/2013 | Taylor | 454/210 |
| 2005/0238478 | A1 | 10/2005 | Belsito et al. | |
| 2006/0199515 | A1 | 9/2006 | Lasko et al. | |
| 2007/0103319 | A1 * | 5/2007 | Pedraza et al. | 340/604 |
| 2008/0015740 | A1 * | 1/2008 | Osann | 700/276 |
| 2009/0114381 | A1 * | 5/2009 | Stroobants | 165/201 |
| 2011/0107512 | A1 * | 5/2011 | Gilbert | 4/596 |
| 2011/0155365 | A1 * | 6/2011 | Wiese | 165/244 |
| 2013/0255909 | A1 * | 10/2013 | Matsumoto | 165/11.1 |
| 2014/0020860 | A1 * | 1/2014 | Matsumoto | 165/11.1 |

* cited by examiner

LOW-PROFILE, CEILING-MOUNTED FAN

RELATED APPLICATIONS

This utility patent application is a continuation of the provisional patent application filed with the United States Patent and Trademark Office on Jul. 1, 2010 and referenced by No. 61/360,692.

FIELD OF THE INVENTION

The present invention relates generally to fans, and in particular, to a low-profile fan having a selectable heating element that is mounted to an overhead surface for distributing air to an area.

BACKGROUND OF THE INVENTION

Ceiling fans are commonly used to improve airflow in homes, businesses, and other living areas. They work by more evenly distributing air layers near the ceiling that may be warmer or cooler than the layers where people are located. In doing so, they help to reduce energy bills and provide a more comfortable living environment. However, the paddle blade design is fraught with disadvantages. First, they require large amounts of ceiling space making them suitable for use only in the middle of large rooms, thus restricting the location from where they may be needed most. Second, they can be somewhat noisy and difficult to keep clean. Third, they can often be fitted with lights, but usually of the incandescent and non-energy efficient type. Finally, they require large amounts of over head clearance and are not suitable for rooms with low ceiling heights. Even if adequate clearance can be provided for the fan, the additional light assembly once again makes them a head knocking challenge.

Various pedestal style fans, tower fans, and portable space heaters are known and are used in locations ill-suited for a ceiling fan or other centrally air-conditioned areas. These alternatives also suffer from disadvantages and deficiencies related to design or utilization. Specifically, these devices are typically small in size and must be placed in a location where direct air flow is desired. Additionally, these devices must be repositioned and are have limited usable range due to the need to be near a power outlet. Furthermore, due to the typically low-level position and horizontal distribution of air flow these devices provide, the optimum air circulation of an area is limited and often times blocked by objects in the area.

SUMMARY OF THE INVENTION

The inventor has therefore recognized the aforementioned inherent problems and lack in the art and observed that there is a need for a means by which a ceiling fan can provide comfort and convenience without the disadvantages described. In accordance with the invention, it is an object of the present embodiments to solve at least one of these problems.

The inventor recognized these problems and has addressed this need by developing a low-profile ceiling-mounted fan that provides the benefits of a ceiling mounted paddle fan without the risk or danger of accidental blade contact. The inventor has thus realized the advantages and benefits of providing the low-profile ceiling-mounted fan having a mounting tray mountable to a mounting surface, such as a ceiling, a component tray fastenable to the mounting tray, and a cover having an air inlet and air outlet that is attached to the component tray and defines an interior chamber. A fan device is attached to the component tray within the interior chamber. At least one lamp is connected to the component tray to provide illumination. A control panel is provided which is in electrical communication with the fan device and the lamp having electrical circuitry for supplying power to the fan device, the lamp, and the control panel. The fan device causes air to pass into the interior chamber through the air inlet and to pass out from the interior chamber through the air outlet.

In a particular embodiment, the fan device includes an elongated cylindrical blower having a plurality air directing fins for drawing air in though the air inlet and forcing air out through the air outlet. A motor is mechanically connected to the blower for rotating the blower along a longitudinal axis. An intake element is provided adjacent to the blower having at least one resistance heating element for selectably heating air drawn into the interior chamber.

In another embodiment, the fan device further includes a plurality of axial fans, each having a plurality air-directing radially disposed blades and a motor for rotating the blades for drawing air in though the air inlet and forcing air out through the air outlet. The intake element is disposed at a lateral end of the component tray having at least one resistance heating element for selectably heating air drawn into the interior chamber.

Furthermore, the described features and advantages of the disclosure may be combined in various manners and embodiments as one skilled in the relevant art will recognize. The disclosure can be practiced without one or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
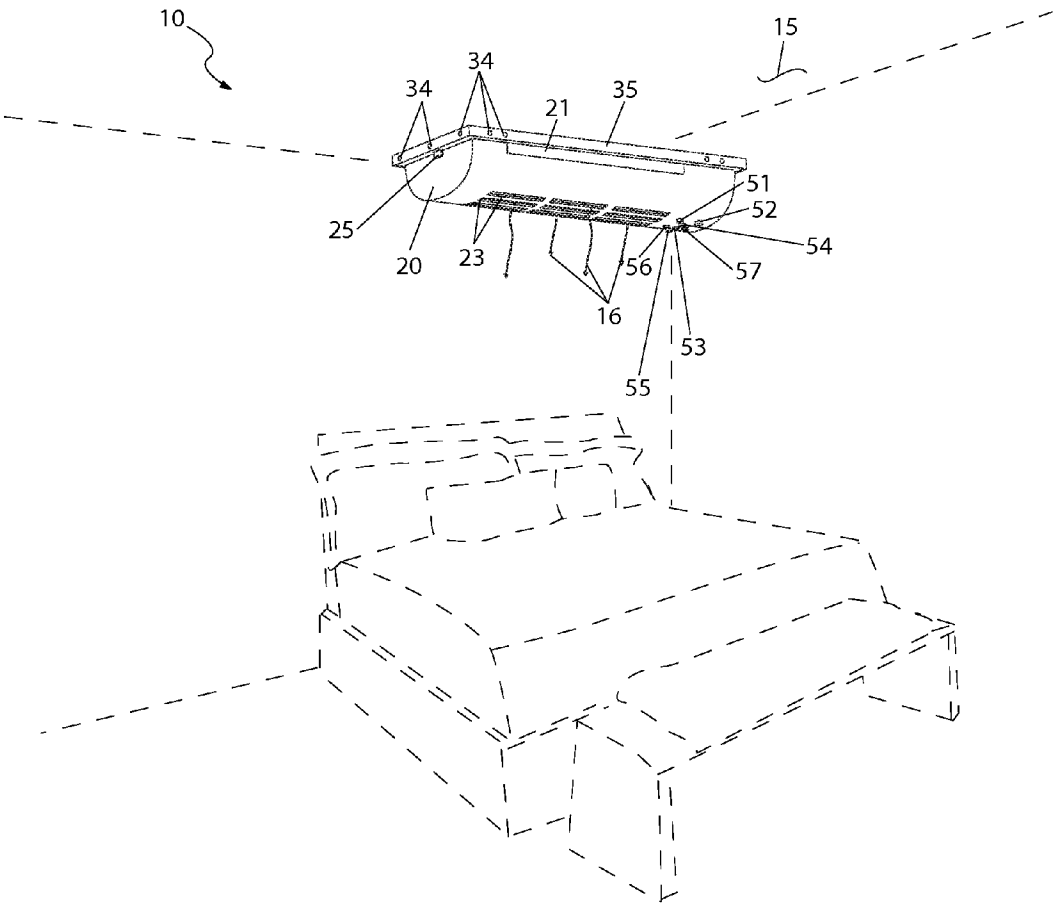
FIG. 1 is an environmental view of a low-profile, ceiling-mounted fan, according to a preferred embodiment in accordance with the invention.

10 low-profile, ceiling-mounted fan
15 mounting surface
16 heated air
17 ambient air
20 cover
21 light panel
22 intake louver

23 outlet louver
24*a* activation button aperture
24*b* receiver aperture
24*c* lamp button aperture
24*d* fan increase button aperture
24*e* fan decrease button aperture
24*f* temp increase button aperture
24*g* temp decrease button aperture
24*h* camera lens aperture
25 latch
30 mounting tray
31 junction box aperture
32 mounting surface aperture
33 mounting tray aperture
34 fastener
35 component tray
36 lamp
37 socket
38 latch aperture
39 component tray aperture
40 fan device
41 motor
42 intake element
43 blower
45 cable
50 control panel
51 activation button
52 receiver
53 lamp activation button
54 blower increase button
55 blower decrease button
56 temperature increase button
57 temperature decrease button
58 camera
59 camera plug
60 remote
61 remote activation button
62 transmitter
63 remote blower increase button
64 remote blower decrease button
65 remote temp increase button
66 remote temp decrease button
67 remote lamp activation button
70 alternate embodiment
71 alternate cover
72 alternate intake louver
73 alternate outlet louver
74 alternate heating element
75 alternate fan
80 signal

DETAILED DESCRIPTION OF THE PREFERRED EMBODIMENT

Figure 3:
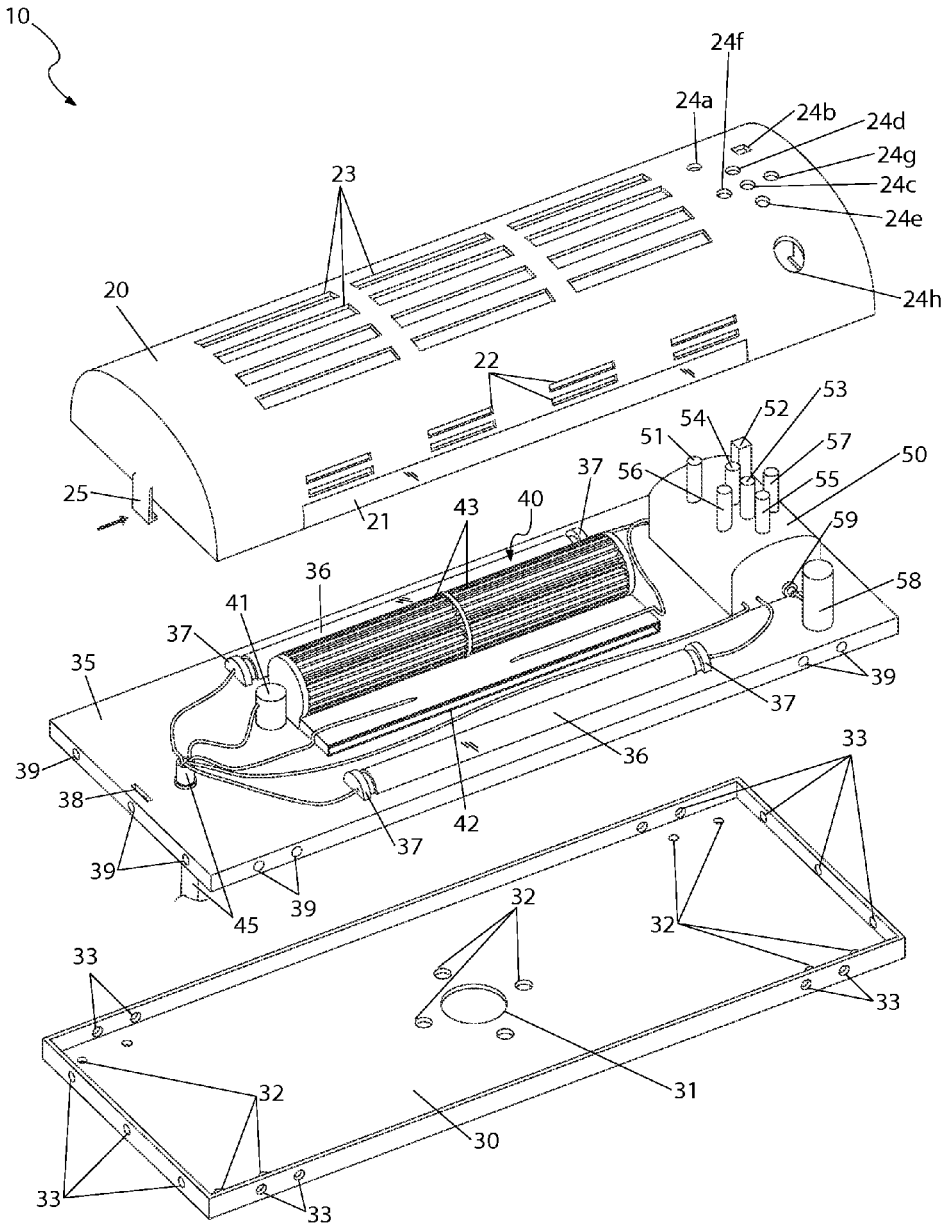
FIG. 3 is an exploded view of the low-profile, ceiling-mounted fan, according to the preferred embodiment.
Figure 4:
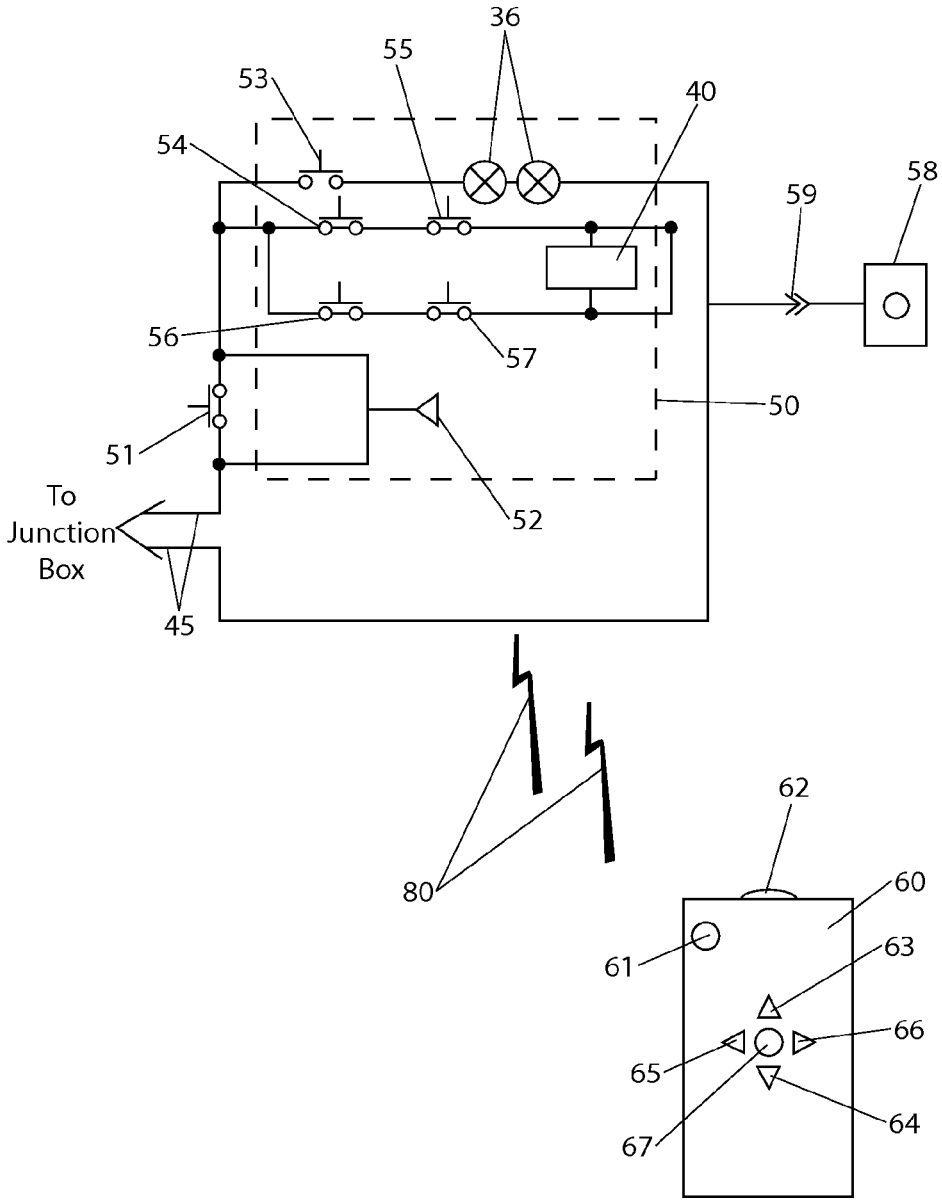
FIG. 4 is an electrical block diagram depicting the major electrical components of the low-profile, ceiling-mounted fan, according to the preferred embodiment of the present invention.
Figure 5:
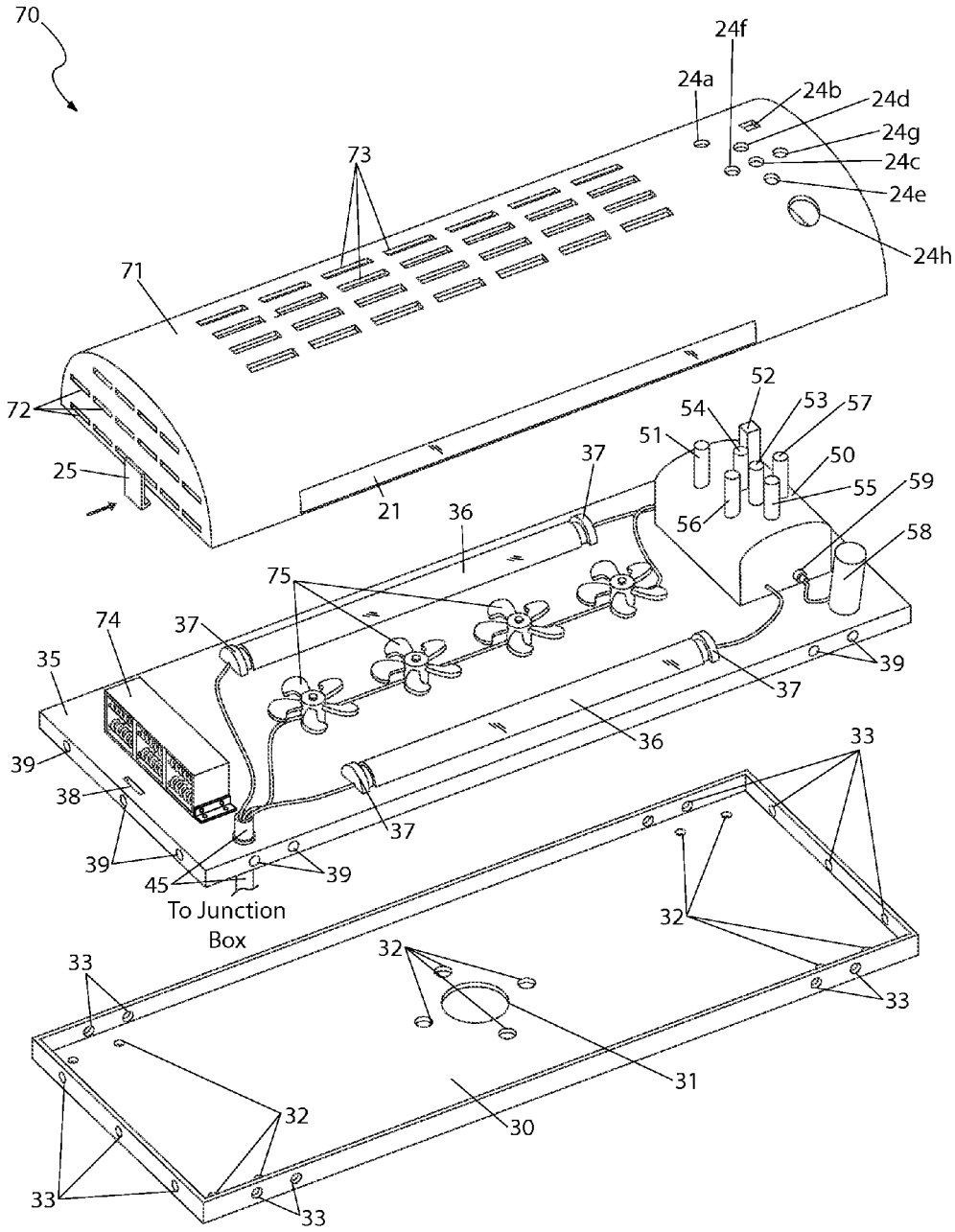
FIG. 5 is a perspective view of an alternate embodiment, according to an alternate embodiment in accordance with the invention; and, FIG. 6 is an electrical block diagram depicting the major electrical components of the alternate embodiment, according to the alternate embodiment.
Figure 6:
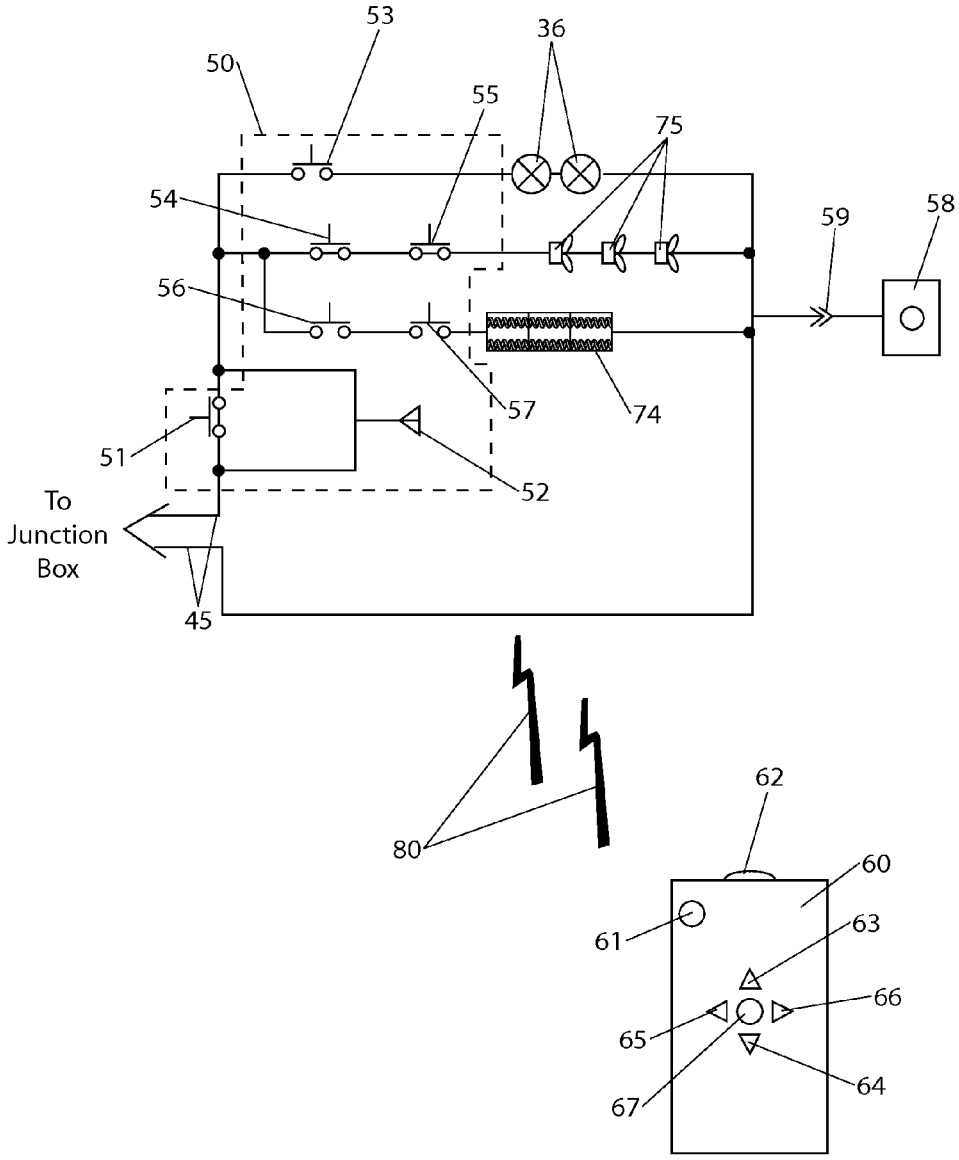

In accordance with the invention, the best mode is presented in terms of a preferred embodiment, herein depicted within FIGS. 1 through 4 and alternately within FIGS. 5 and 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 4, depicting a low-profile, ceiling-mounted fan (herein described as an "apparatus") 10 and FIGS. 5 and 6 depicting an alternate embodiment 70, where like reference numerals represent similar or like parts. In accordance with the invention, the present disclosure describes an apparatus 10 which provides a fan assembly utilized on an overhead and horizontal, low-clearance mounting surface 15, such as ceilings in a basement, patio, attic, or the like. It can be appreciated that the apparatus 10 can also be mounted on vertical surfaces as well, such as walls.

Figure 2:
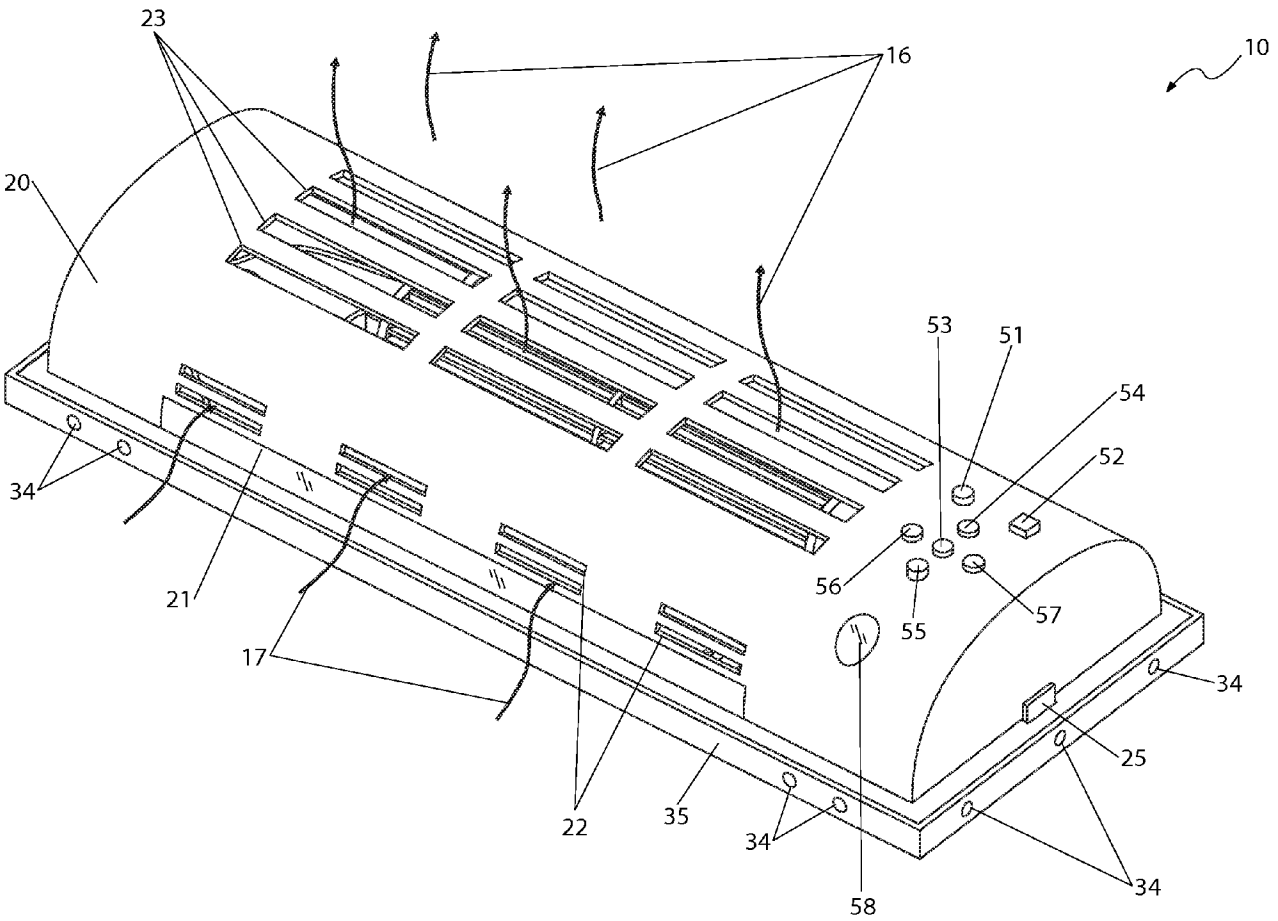
FIG. 2 is a perspective view of the low-profile, ceiling-mounted fan, according to the preferred embodiment.

FIG. 1 shows an environmental view of the apparatus 10 and FIG. 2 shows a perspective view of the apparatus 10. The apparatus 10 generally includes a cover 20, a mounting tray 30, a component tray 35, and other enhancing features. The apparatus 10 is utilized in both commercial and residential areas and mounts to a desired mounting surface. The apparatus 10 is preferably fabricated from a molded plastic, yet other materials can be utilized without limiting the scope of this disclosure.

As illustrated in FIG. 1, once mounted to the mounting surface 15, the apparatus 10 heats ambient air 17 into heated air 16 which is then distributed throughout a living area in an unobstructed manner. The apparatus 10 measures approximately fifty-two (52) inches long, twelve (12) inches wide, and five (5) inches deep. Internally, the apparatus 10 includes a fan device 40, a control panel 50, and other mechanisms to facilitate air flow. The internal components are protected by the cover 20 this is depicted as having an arcuate shape. It can be appreciated that other shapes can be utilized without limiting the scope of the apparatus 10. The apparatus 10 includes a remote 60 (see FIG. 4) which provides remote activation and deactivation functions of the apparatus 10 to the user from a distance.

FIG. 3 shows an exploded view of the apparatus 10. The cover 20 of the apparatus 10 includes a pair of light panels 21, an intake louver 22, and an outlet louver 23. Each light panel 21 diffuses illumination provided by the internal lamps 36, which are positioned behind to the panels 21. Each light panel 21 is molded into the cover 20 and fabricated from a translucent plastic material in a variety of colors and patterns. The intake louver 22 provides access to the interior when the fan 40 draws in ambient air 17. The intake louver 22 is located on an upper surface of the cover 20. After being drawn in, the ambient air 17 is heated by an intake element 42 of the fan device 40 and then forced out by a blower 43 through the outlet louver 23 into the desired area. The intake louver 22 and outlet louver 23 provide perforations for the ambient air 17 and heated air 16 to enter and exit, respectively, they also acts as a protection against accident contact to the internal components.

An upper side surface of the cover 20 includes various apertures 24*a*, 24*b*, 24*c*, 24*d*, 24*e*, 24*f*, 24*g*, 24*h*, each of which provide access to corresponding components of the control panel 50 to protrude through. For example, an activation button aperture 24*a* allows an activation button 51 to be inserted through, a receiver aperture 24*b* allows a receiver 52 to be inserted through, a lamp activation aperture 24*c* allows a lamp activation button 53 to be inserted through, a fan increase aperture 24*d* allows a fan increase button 54 to be inserted through, a fan decrease aperture 24*e* allows a fan decrease button 55 to be inserted through, a temperature increase aperture 24*f* allows a temperature increase button 56 to be inserted through, a temperature decrease aperture 24*g* allows a temperature decrease button 57 to be inserted through, and a camera lens aperture 24*h* allows a camera 58 to be inserted through.

Opposing lateral side surfaces of the cover 20 each includes an integrally molded flexible "L"-shaped latch 25. The latch 25 releasably attaches the cover 20 to the component tray 35. Each latch 25 is depressed inwardly to engage and disengage the latch apertures 38 upon the component tray 35.

The component tray 35 is mounted to the mounting surface 15 by attachment to the mounting tray 30. The mounting tray 30 includes a five (5) sided shallow platform with an open upper surface. The mounting tray 30 includes various apertures 31, 32, 33 for interconnection to an existing electrical junction box, securing to the mounting surface 15, and securing to the component tray 35. An intermediate portion of the mounting tray 30 includes a junction box aperture 31 which allows a length of cable 45 to be interconnected to the household or industrial electrical junction box for further supplying the apparatus 10 with power. The junction box aperture 31 is appropriately sized for insertion of the cable 45. Surrounding the junction box aperture 31 and upon each corner of the mounting tray 30 are a plurality of mounting surface apertures 32. The mounting surface apertures 32 allow fasteners 34, such as screws, to be inserted and fastened and secured into the desired mounting surface 15. The mounting tray 30 is secured into the existing structural studs within the mounting surface 15 to provide adequate support. Upward surfaces of the mounting tray 30 include a plurality of mounting tray apertures 33. The mounting tray apertures 33 allow the component tray 35 to be positioned over the mounting tray 30 and secured by fasteners 34.

The component tray 35 is a five (5) sided open bottom platform for securing the lamps 36, fan device 40, and control panel 50. The component tray 35 is slightly larger than the mounting tray 30 to allow the sides of component tray 35 to be placed within the mounting tray 30. The component tray 35 includes a plurality of component tray apertures 39 which align with the mounting tray apertures 33. The aligned tray apertures 33, 39 are secured with fasteners 34 to fix the component tray 35 to the mounting tray 30. The cover 20 is positioned over an upper surface of the component tray 35 to cover and protect the lamps 36, fan device 40, and control panel 50. The latches 25 upon the cover 20 secure within respective latch apertures 38 also upon opposing upper lateral end portions of the component tray 35.

The lamps 36 are linear fluorescent light bulbs. It can be appreciated that other illuminations means, such as light-emitting diodes or the like, can be utilized to illuminate the area without limiting the scope of the apparatus 10. The lamps 36 are preferably located at an internal upper and lower longitudinal side surfaces of the apparatus 10, yet other locations can also be utilized. Each lamp 36 is secured and electrically connected with the control panel 50 by a pair of sockets 37. The end portion of the lamps 36 are inserted into the respective sockets 37 in a twisting manner. The lamps 36 are interconnected by electrical wiring to the control panel 50 and to the cable 45. The cable 45 is routed through the component tray 35 through the junction box aperture 31 upon the mounting tray 30 to the junction box.

The fan device 40 is fixed to an intermediate portion of the component tray 35 and includes the intake element 42 and the blower 43. The fan device 40 is preferably a TUTCO-FARNAM© CROSS-FLOW HEATER which includes an integral motor 41 to power the intake element 42 and the blower 43. The intake element 42 provides suction intake through a negative pressure which draws in ambient air 17 from the exterior of the apparatus 10 and heats the ambient air 17 as it passes over a resistive heating element to a desired temperature. The heated air 16 is distributed to the area by the blower 43. The intake element 42 also includes an adjustable ceramic heater which increases the temperature of the ambient air 17. The intake louver 22 protects users from unintentional contact with the heating element 42 and the outlet louvers 23 protect users from unintentional contact with the blower 43. The fan device 40 is electrically connected by electrical wiring to the control panel 50 and to the cable 45.

The control panel 50 includes a plurality of buttons 51, 53, 54, 55, 56, 57, a receiver 52, and associated electronic devices, such as an integrated circuit which controls the functional features of the apparatus 10. An activation button 51 activates and deactivates the apparatus 10, the receiver 52 receives a signal 80 from the remote 60 to control various functional settings, a lamp activation button 53 activates and deactivates the lamps 36, a blower increase button 54 and a blower decrease button 55 control the speed of the blower 43, and a temperature increase button 56 and temperature decrease button 57 control the temperature of the intake element 42. The control panel 50 electrically connected by electrical wiring to the cable 45 and to the junction box. The buttons 51, 53, 54, 55, 56, 57 and the receiver 52 are inserted through a respective aperture 24*a*, 24*b*, 24*c*, 24*d*, 24*e*, 24*f*, 24*g* upon the cover 20. Each button 51, 53, 54, 55, 56, 57 is a pushbutton electrical switch; however it can be appreciated that other electrical switches can be utilized without limiting the scope of the apparatus 10. The control panel 50 is connected to a security camera 58 by a camera plug 59. The camera 58 is a closed-circuit television camera including internal components which enable transmission to a reviewing unit (not shown). Alternately, the apparatus 10 can exclude the camera 58 and camera plug 59 for other embodiments of the apparatus 10.

FIG. 4 shows an electrical block diagram depicting the major electrical components of the apparatus 10. The apparatus 10 is electrically connected to the junction box by the cable 45 which provides electrical power to the buttons 51, 53, 54, 55, 56, receiver 52, lamp 36, and fan device 40. Actuation of the activation button 51 transmits power to the receiver 52, other buttons 53, 54, 55, 56, 57, and camera 58. The activated receiver 52 receives a signal 80 from the remote 60 to control the lamps 36 and fan device 40. The user can activate and deactivate the lamps 36 and fan device 40 as desired by the respective buttons 53, 54, 55, 56, 57.

The remote 60 includes a durable plastic shell which houses a transmitter 62 and remote buttons 61, 63, 64, 65, 66, 67 which correspond to the buttons 53, 54, 55, 56, 57 of the control panel 50. A remote activation button 61 activates the apparatus 10, a remote blower increase button 63 and remote blower decrease button 64 controls the speed of the blower 43, a remote temp increase button 65 and remote temp decrease button 66 controls the temperature of the intake element 42, and a remote lamp activation button 67 controls the lamps 36. The remote 60 is supplied with power from a user replaceable battery which is housed within the remote 60.

FIG. 5 shows a perspective view of an alternate embodiment 70 and FIG. 6 shows an electrical block diagram depicting the major electrical components of the alternate embodiment 70. The alternate embodiment 70 includes an alternate cover 71 and alternate heating element 74 and alternate fan 75 utilized to provide air flow to the area. The alternate embodiment 70 is suspended from the mounting surface 15 by the mounting tray 30. The alternate cover 71 is similar to the cover 20 and includes an alternate intake louver 72 and an alternate outlet louver 73 which correspond to the positioning of an alternate heating element 74 and a plurality of alternate fans 75, respectively. The alternate intake louver 72 is positioned upon a lateral side surface of the alternate cover 71 to correspond to the position of the alternate heating element 74. The alternate heating element 74 is a resistive heating element, such as a ceramic heater, which is separated from the alternate fan 75. The ambient air 17 is drawn through the alternate intake louver 72 and is heated by the alternate heating element 74 to a desired temperature. The heated air 16 is then distributed through the alternate outlet louver 73 by the alternate fans 75. The alternate fans 75 include of up to four (4) axial fans which include a plurality of blades, a shaft, and a motor. The alternate fans 75 are located at an intermediate position upon the component tray 35 and are aligned in a linear and parallel manner. The alternate embodiment 70 is electrically connected to the junction box and current is routed through the control panel 50 and associated buttons 51, 53, 54, 55, 56, 57, receiver 52, camera 58, and to the lamps 36, alternate heating element 74 and alternate fan 75.

It can be appreciated by one skilled in the art that other styles and configurations of the invention can be easily incorporated into the teachings of the present disclosure and only two particular configurations have be shown and described for purposes of clarity and disclosure and not by way of limitation of scope.

In accordance with the invention, the preferred embodiment can be utilized by the user in a simple and effortless manner with little or no training. After initial purchase or acquisition of the apparatus 10, it is installed and utilized as indicated in FIGS. 1 through 3. After initial purchase or acquisition of the alternate embodiment 70, it is installed and utilized as indicated in FIGS. 4 and 5.

The method of utilizing the apparatus 10 can be achieved by performing the following steps: acquiring the apparatus 10; installing the mounting tray 30 onto the mounting surface 15 by aligning the junction box aperture 31 with the junction box and securing each mounting surface aperture 32 with a fastener 34; routing the cable 45 from the component tray 35 through the junction box aperture 31 and into the junction box; installing the component tray 35 onto the mounting tray 30 by aligning each component tray aperture 39 with the respective mounting tray apertures 33 and securing with a fastener 34; fixing the cover 20 onto the component tray 35 by engaging the latches 25 with the respective latch apertures 38 upon the component tray 35; activating the apparatus 10 by the activation button 51 and controlling lamps 36 and fan device 40 with the respective buttons 53, 54, 55, 56, 57; and, utilizing the remote 60 to control the apparatus 10.

The method of utilizing the alternate embodiment 70 can be achieved by performing the following steps: acquiring the alternate embodiment 70; installing the mounting tray 30 onto the mounting surface 15 by aligning the junction box aperture 31 with the junction box and securing each mounting surface aperture 32 with a fastener 34; routing the cable 45 from the component tray 35 through the junction box aperture 31 and into the junction box; installing the component tray 35 onto the mounting tray 30 by aligning each component tray aperture 39 with the respective mounting tray apertures 33 and securing with a fastener 34; fixing the alternate cover 71 onto the component tray 35 by engaging the latches 25 with the respective latch apertures 38 upon the component tray 35; activating the apparatus 10 by the activation button 51 and controlling lamps 36, alternate heating element 74, and alternate fans 75 with the respective buttons 53, 54, 55, 56, 57; utilizing the remote 60 to control the apparatus 10; and utilizing the apparatus 10 to control the air flow in the area.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A low-profile ceiling-mounted fan comprising:

a mounting tray mountable to a mounting surface;

a component tray fastenable to said mounting tray;

a cover having an air inlet and air outlet attached to said component tray defining an interior chamber;

a fan device attached to said component tray within said interior chamber;

at least one lamp connected to said component tray;

a control panel in electrical communication with said fan device and said lamp; and, electrical circuitry supplying power to said fan device, said lamp, and said control panel;

whereby said fan device causes air to pass into said interior chamber through said air inlet and to pass out from said interior chamber through said air outlet.

2. The fan of claim 1, wherein said fan device further comprises:

an elongated cylindrical blower having a plurality air directing fins for drawing air in though said air inlet and forcing air out through said air outlet;

a motor for rotating said blower along a longitudinal axis; and, an intake element adjacent to said blower having at least one resistance heating element for selectably heating air drawn into said interior chamber prior to entering an intake of said blower.

3. The fan of claim 2, wherein said air inlet further comprises a plurality of intake louvers disposed on said cover in front of said intake element when said cover is attached to said component tray for directing said air drawn into said interior region; and, said air outlet further comprises a plurality of outlet louvers disposed on said cover in front of said blower when said cover is attached to said component tray for directing air forced out from said interior region.

4. The fan of claim 3, wherein said control panel further comprises a plurality of control buttons for controlling at least a rotational speed of said blower, a temperature of said at least one heating element, and activation of said lamp.

5. The fan of claim 4, further comprising a remote control in radio communication with a receiver electrically connected to said control panel for controlling at least said rotational speed of said blower, said temperature of said heating element, and said activation of said lamp.

6. The fan of claim 5, wherein said cover further comprises:

a pair of latches disposed on opposing lateral sides for releasably attaching to said component tray; and, a plurality of button apertures to provide access to said plurality of control buttons from an exterior of said cover.

7. The fan of claim 6, wherein said mounting tray further comprises a generally rectangular flat back, four outwardly extending side walls, an open front, and a junction box aperture in said flat back;

wherein a cable is electrically connected to a power source and passes through said junction box aperture for electrical connection to sad electrical circuitry.

8. The fan of claim 7, wherein said component tray further comprises a generally rectangular flat front, four inwardly extending side walls, and an open back suitably sized to fit within said mounting tray such that said component tray side walls are in contact with said mounting tray side walls.

9. The fan of claim 8, wherein said component tray further comprises at least one pair of sockets to electrically connect said lamp to said control panel and at least one translucent light panel disposed in front of said lamp when said cover is attached to said component tray.

10. The fan of claim 9, further comprising a video camera in electrical communication with said control panel for recording and transmitting video images to a remote observation location.

11. The fan of claim 1, wherein said fan device further comprises:

a plurality of axial fans each having a plurality air-directing radially disposed blades and a motor for rotating said blades for drawing air in though said air inlet and forcing air out through said air outlet; and, an intake element disposed at a lateral end of said component tray having at least one resistance heating element for selectably heating air drawn into said interior chamber prior to entering an intake of said plurality of fans.

12. The fan of claim 11, wherein said an air inlet further comprises a plurality of intake louvers disposed on a lateral side surface of said cover adjacent to said intake element when said cover is attached to said component tray for directing said air drawn into said interior region; and, said air outlet further comprises a plurality of outlet louvers disposed on said cover in front of said plurality of fans when said cover is attached to said component tray for directing air forced out from said interior region.

13. The fan of claim 12, wherein said control panel further comprises a plurality of control buttons for controlling at least a rotational speed of said each fan, a temperature of said at least one heating element, and activation of said lamp.

14. The fan of claim 13, further comprising a remote control in radio communication with a receiver electrically connected to said control panel for controlling at least said rotational speed of said each fan, said temperature of said heating element, and said activation of said lamp.

15. The fan of claim 14, wherein said cover further comprises:

a pair of latches disposed on opposing lateral sides for releasably attaching to said component tray; and, a plurality of button apertures to provide access to said plurality of control buttons from an exterior of said cover.

16. The fan of claim 15, wherein said mounting tray further comprises a generally rectangular flat back, four outwardly extending side walls, an open front, and a junction box aperture in said flat back;

wherein a cable is electrically connected to a power source and passes through said junction box aperture for electrical connection to sad electrical circuitry.

17. The fan of claim 16, wherein said component tray further comprises a generally rectangular flat front, four inwardly extending side walls, and an open back suitably sized to fit within said mounting tray such that said component tray side walls are in contact with said mounting tray side walls.

18. The fan of claim 17, wherein said component tray further comprises at least one pair of sockets to electrically connect said lamp to said control panel and at least one translucent light panel disposed in front of said lamp when said cover is attached to said component tray.

19. The fan of claim 18, further comprising a video camera in electrical communication with said control panel for recording and transmitting video images to a remote observation location.

20. A low-profile ceiling-mounted fan comprising:

a mounting tray mountable to a mounting surface;

a component tray fastenable to said mounting tray;

a cover having an air inlet and air outlet attached to said component tray defining an interior chamber;

at least one fan attached to said component tray within said interior chamber;

at least one motor for rotating said fan;

at least one resistance heating element;

at least one lamp connected to said component tray;

a control panel for controlling at least a rotational speed of said motor, a temperature of said heating element, and activation of said lamp;

electrical circuitry supplying power to said motor, said lamp, and said control panel; and, a remote control in radio communication with a receiver electrically connected to said control panel;

wherein said fan causes air to pass into said interior chamber through said air inlet across said heating element prior to entering an intake of said fan and to pass out from said interior chamber through said air outlet; and, wherein said air is selectably heated by said heating element.

* * * * *